United States Patent [19]

Jones

[11] 4,403,928

[45] Sep. 13, 1983

[54] MULTI-UNIT ROTARY MECHANISM

[75] Inventor: Charles Jones, Hillsdale, N.J.

[73] Assignee: Curtiss-Wright Corporation, Wood-Ridge, N.J.

[21] Appl. No.: 248,950

[22] Filed: Mar. 30, 1981

[51] Int. Cl.[3] ..... F01C 11/00

[52] U.S. Cl. ..... 418/60; 418/151

[58] Field of Search ..... 418/60, 151

[56] References Cited

U.S. PATENT DOCUMENTS

| | | | |
|---|---|---|---|
| 3,077,867 | 2/1963 | Froede | 418/60 |
| 3,240,423 | 3/1966 | Jones | 418/60 |
| 3,883,273 | 5/1975 | King | 418/60 |
| 4,268,231 | 5/1981 | Corwin | 418/60 |

FOREIGN PATENT DOCUMENTS

| | | | |
|---|---|---|---|
| 545214 | 5/1942 | United Kingdom | 418/60 |
| 1202295 | 8/1970 | United Kingdom | 418/60 |

*Primary Examiner*—Ronald H. Lazarus

*Attorney, Agent, or Firm*—Arthur L. Frederick; Stephen A. Roen

[57] ABSTRACT

A modular two-unit rotary piston mechanism, each unit having a rotor, and a common mainshaft having a pair of eccentrics which are rotatively offset by 120 degrees and which support the rotors; this module is especially useful in forming a triple engine by coupling a single unit rotor to the common mainshaft so that the eccentric of the single unit is rotatively offset 120 so degrees from both eccentrics of the two-unit module.

3 Claims, 2 Drawing Figures

MULTI-UNIT ROTARY MECHANISM

The invention herein described was made in the course of, or under Contract No. N000 24-77-C-5324 with the Department of the Navy and the Government is licensed under the patent and has minimum rights set forth in ASPR Section 7-302.23(a).

BACKGROUND OF THE INVENTION

This invention relates to multi-unit rotary mechanisms of the type disclosed in U.S. Pat. No. 2,988,065, granted June 13, 1961, to Wankel et al, and particularly to such an engine designed for operation as a stratified charge engine, for example, as disclosed in U.S. Pat. No. 3,246,636, granted Apr. 19, 1966 to Bentele and U.S. Pat. No. 3,894,518, granted July 15, 1975 to Gavrun et al.

In multi-unit, rotary piston mechanisms comprising more than two units (a unit being one rotor supported on a mainshaft for planetary rotation in a housing cavity and the housing cavity defining the cavity) such as exemplified in U.S. Pat. No. 3,077,867, granted Feb. 19, 1963, to Froede et al, are utilized when it is desired to provide increased power output by combining a plurality of rotary units into a single power plant. Preferably, such multiple rotary engine power plants should have a uniform interval between the firing of the working chambers, axially aligned positions for both the inlet and outlet passages of the rotary engine units as well as maximizing the commonality of parts.

One form of triple rotor engine can be made by combining a conventional "stand-alone" two-unit rotary engine; that is, an engine which is independently functionally operative without the necessity of modifications such as changes in engine balance or ignition interval, with a single unit engine. Such a conventional stand-alone two-unit engine would have its rotor eccentrics offset by 180 degrees in order to provide uniform intervals between the firing of the working chambers as is exemplified in the two-unit rotary engines of the aforementioned Froede et al patent. Coupling such a two-unit rotary engine to another single unit rotary engine will inherently result in a triple rotor engine having unequal firing intervals with the inherent disadvantages. Ideally, a triple rotary engine should have equal interval of firing ignition as exemplified in the U.S. Pat. No. 3,528,084, granted Sept. 8, 1970, to Hohenlohe wherein an integral three rotor engine is shown having its eccentrics rotatively offset by 120 degrees.

Accordingly, it is an object of this invention to provide a modular two-unit, rotary piston engine, which, without modification, can be easily coupled to a single unit rotary piston engine to create a triple engine having equal firing intervals and the smoothest possible output.

It is a further object of this invention to provide a modular two-unit, rotary piston engine which is separately, rotatively, dynamically balanced, which can be easily coupled to a single unit rotary piston engine which is similarly balanced to create a triple rotor engine having equal firing intervals and the smoothest possible output.

A still further object of this invention is to provide a triple rotor rotary engine having completely aligned rotor housings consisting of a modular, stand-alone two-unit, rotary piston engine coupled to a single unit piston engine which triple rotor engine achieves the smoothest possible output.

The foregoing and related objects are obtained in accordance with the invention which in its broader aspects provides a modular two-unit, rotary piston mechanism, each unit having a housing forming a cavity in which a rotor is eccentrically supported for planetary rotation so as to form a plurality of working chambers defined between the rotor and its housing which successively expand and contract in volumetric size as the rotor planetates relative to the housing. The housing is provided with an intake port means for introducing air into the working chambers and an exhaust port means for discharging products of combustion from the working chambers, a common mainshaft extending coaxially through the housing's cavities and having a pair of axially-shaped eccentric portions, one for each housing cavity. This pair of eccentric portions are rotatively offset 120 degrees.

In a narrower aspect of this invention, the intake port means of each housing are disposed one behind the other when viewed in a direction parallel to the shaft axis and where the exhaust port means of each housing are similarly disposed.

In another narrower aspect of this invention, a triple rotor engine is formed comprising the aforesaid two-unit engine and a single unit engine. The two-unit engine is coupled to the single unit engine in such a manner that the eccentric portion of the single unit engine is rotatively offset 120 degrees from the eccentrics of the two-unit engine.

Other objects of the invention will become apparent upon reading the specification taken in connection with the accompanying drawings.

DESCRIPTION OF A PREFERRED EMBODIMENT

Figure 1:
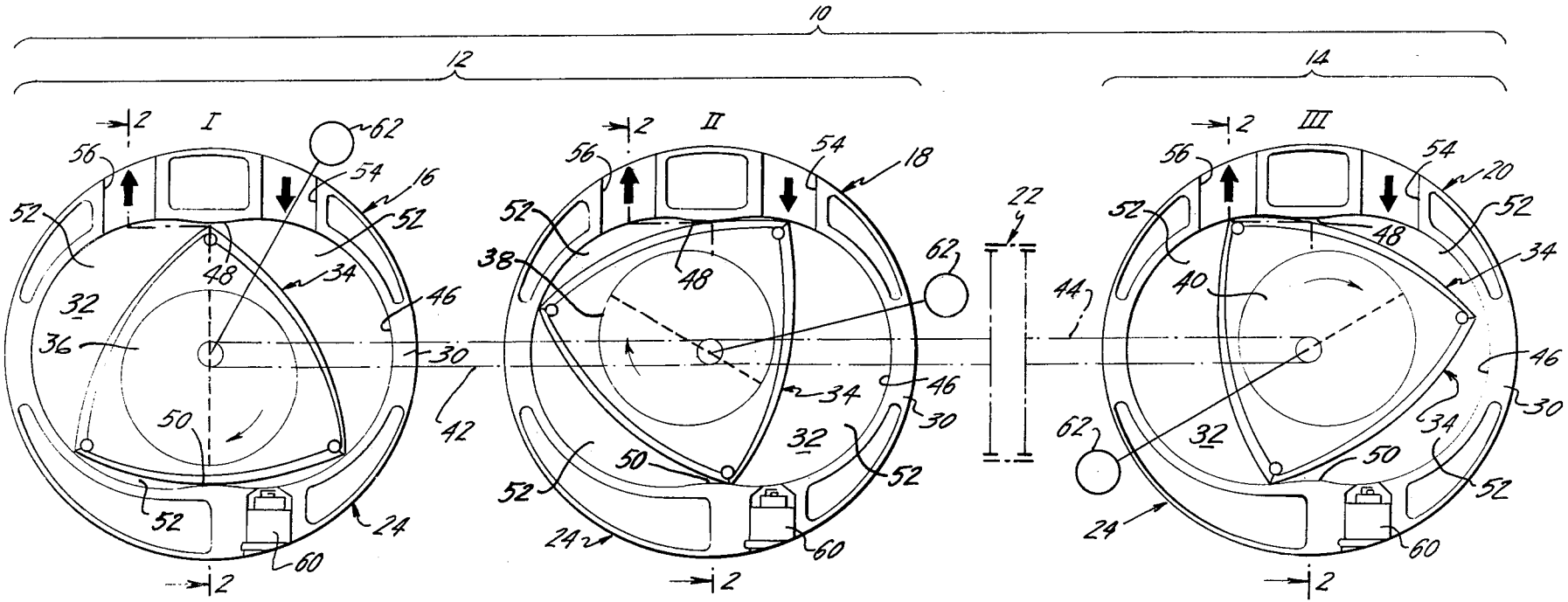
FIG. 1 is a schematic traverse view of a triple rotor engine according to the invention, each unit being shown in traverse section which, for clarity of the drawing, is shown side by side, although in the actual engine, each unit would be directly behind the other.
Figure 2:
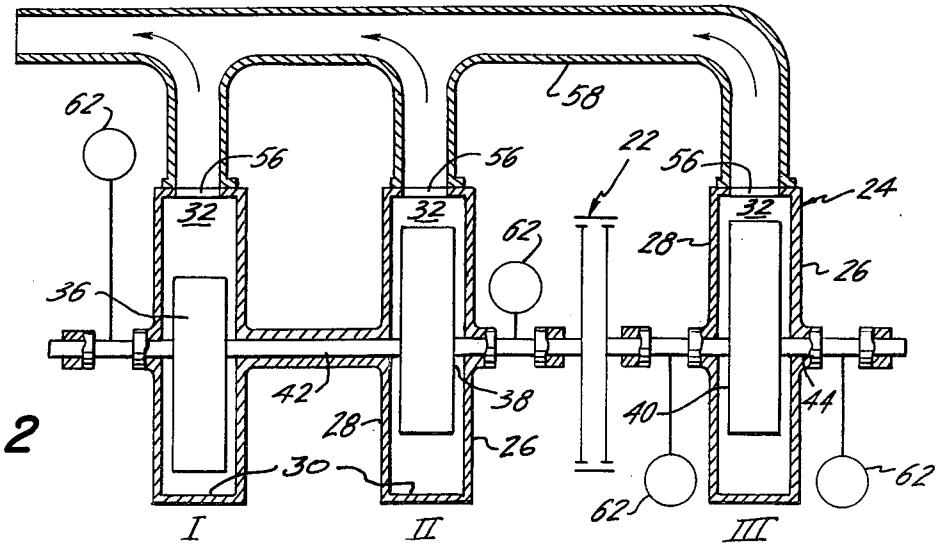
FIG. 2 is a schematic axial sectional view of the engine of FIG. 1, each unit being shown without its rotor.

Now, referring to the drawings, a triple engine is schematically indicated at 10, comprising a two-unit engine 12 coupled to a single unit engine 14. The two-unit engine 12 comprises a first and second rotary piston mechanism, I and II, or 16 and 18, and the single unit engine 14 comprises a third rotary piston mechanism III or 20, coupled together by coupling means 22, each rotary piston mechanism being generally similar to that described in the aforementioned patents and similar to each other. FIG. 1 shows each unit in traverse section; for clarity of illustration, however, the engine units or rotary piston mechanisms are shown side by side although in the actual engine, each unit would be directly behind the other as illustrated in FIG. 2, which figure is a schematic axial section view of the engine of FIG. 1.

Each rotary piston mechanism is schematically shown as comprising an outer body or housing 24 including two axially-spaced end housing 26 and 28 and an intermediate or rotor housing 30, these housing parts being secured together to form an engine internal cavity 32. An inner body or rotor 34 (shown only in FIG. 1), is journaled for rotation within the housing cavity 32 on an eccentric portion 36, 38 and 40 of a first second and third rotary piston mechanism I, II and III, respectively, and eccentric portions 36 and 38 are supported for rotation on a common mainshaft 42 and eccentric portion 40 is supported for rotation on its own mainshaft 44. Common mainshaft 42 extends coaxially through its housing cavities 32 and is supported at its ends by end housings 26 and 28. Similarly, mainshaft 44 extends coaxially through its single housing cavity 32 and is supported at its ends by end housings 26 and 28.

Each intermediate housing 30 has a peripheral inner surface or trochoid surface 46 which is illustrated as having a two-lobe profile which preferably is basically epitrochoidal in configuration said two lobes joining at junctions 48 and 50 which are disposed relatively near to the piston mechanism's axis. The rotor 34 has a generally triangular profile with its apex portions having sealing cooperation with the epitrochoidal surface or peripheral inner surface 46 to form three working chambers 52 between the rotor 34 and housing walls 26 and 28.

Each piston mechanism includes suitable timing gears (not shown) between the rotor 34 and its housing 24 to maintain the requisite angular relationship of the rotor, housing and shaft; such timing gears are conventional and may be similar to those illustrated in the U.S. patents to Bentele et al., U.S. Pat. No. 3,111,261, granted Nov. 19, 1963, and Jones et al., U.S. Pat. No. 3,655,302, granted Apr. 11, 1972. In addition, each engine unit's housing includes an air intake passage or port 54 disposed adjacent to and on one side of one lobe 48 of the trochoid surface 46 and an exhaust passage or port 56 disposed on the other side of said lobe 48; the exhaust ports 56 are connected to a common exhaust conduit 58. Combustion is initiated in the engine working chambers adjacent to the other lobe 50 of the trochoid surface by, preferably a stratified charge injection system comprising the combination of a fuel injection nozzle (not shown) and adjacent ignition means 60, such as a spark plug, as is disclosed in the U.S. patents to Bentele, U.S. Pat. No. 3,246,636 and Jones, U.S. Pat. No. 3,698,364.

Each piston mechanism, as thus far described, functions with rotor 34 rotating in the direction of the arrow in FIG. 1, so that each working chamber 52 periodically increases from a minimum volume condition, when it is located adjacent to lobe junction 48 and opens the intake port 54, to a maximum volume condition and closes the intake port 54 and then said chamber decreases in volume to compress the air trapped therein until the working chamber 52 again reaches a maximum volume condition at lobe junction 50. Thereafter, the volume of said chamber increases to a maximum under expanding gas pressure and then decreases to a minimum as the chamber comes into communication with the exhaust port 56 at lobe junction 48 to thus complete the cycle. To effect combustion of fuel in each working chamber 32 after substantial compression of air therein, the stratified charge injection system, including spark plug 60, is provided.

As can be seen in FIG. 2, the profiles of the cavities 32 of all three housings 24 are axially aligned. In addition, the inlet ports 54 are likewise aligned; that is, when viewed in a direction parallel to the crankshaft's axis the single inlet port 54 of each housing 24 is directly behind the other. The outlet ports 56 are similarly also axially aligned. The crankshaft eccentric portions 36 and 38 of common mainshaft 42 of piston mechanisms I and II are, however, rotatively offset by 120 degrees. The crankshaft eccentric portion 40 of the crankshaft 44 of piston mechanism III of single unit engine 14, is coupled to the two-unit engine 12 through coupling means 22 (described in more detail infra) so that eccentric portion 40 of the single unit engine 14, is rotatively offset 120 degrees from the eccentrics 36 and 38 of the two-unit engine 12 thereby forming a triple rotor engine having its three eccentrics equally, rotatively angularly offset, 120 degrees apart.

It can be seen from the views of FIG. 1 that the firing positions of the working chambers of each of the three piston mechanisms are equally spaced or staggered 120 degrees as regards their cycle, from those of the adjacent piston mechanism thereby ensuring even firing sequences and smoothest possible output.

As shown in FIGS. 1 and 2, the eccentric portions 36 and 38 of common mainshaft 42 of piston mechanism I and II are rotatively displaced 120 degrees relative to each other and this common mainshaft 42 is provided with conventional counterweight means 62 for providing separate rotative, dynamic balance of this mainshaft 42 in order to balance the centrifugal forces on the rotating eccentric parts. Similarly, separate rotative dynamic balancing is conventionally provided mainshaft 44 of piston mechanism III by providing conventional counterweight means 62. The techniques for engine balance are described, for example, in chapter 7 of Mechanics of Machinery by Ham & Crane, 1948, published by McGraw-Hill Book Co.

The coupling means 22, utilized to connect the mainshafts of the two-unit engine 12 to the single unit engine 14 so as to permit angular, radial and endwise axial flexibility relative to the mainshaft axes of these engines and torsional stiffness for torque transmission between these connected mainshafts while eliminating the transmission of dynamic bending moments, is described in detail, for example, in co-pending patent application of Jones and Corwin, Multi-Unit Rotary Piston Mechanism and Mainshaft Coupling Therefor, filed Apr. 4, 1979, of the same assignee, the relevant portions of which are incorporated herein by reference. Furthermore, though the schematic drawing of FIG. 2 shows each of unit I and II of the two-unit engine 12 as having housings which are separated from each other, in actual construction these two units are subassemblies of a single two rotor (rotary piston) unit, as described, for example in the aforementioned co-pending patent application.

It is believed now readily apparent that the present invention provides a "stand alone", modular two-unit rotary piston engine, which, when connected as described, to a single conventional one unit rotary piston engine which is conventionally completely and separately balanced, a triple rotor engine is capable of being formed which engine has its rotor housing aligned as per conventional engine assembly methods while having regular, even, firing sequences thereby providing the smoothest possible output, and while having a very high degree of commonality of parts. With regard to the latter advantage, all that is required to convert a conventional two-unit rotary piston engine is to replace its common mainshaft by one having eccentric portions offset by 120 degrees instead of 180 degrees and replace its counterweights by new ones. All other parts will be common, both for the new modular two-unit rotary piston mechanism of the present invention and the addon, or coupled, single unit engine which when connected results in a triple rotor engine.

What is claimed is:

1. A three-rotor modular rotary piston mechanism consisting of a single rotor mechanism unit and a two-rotor mechanism unit with each mechanism unit having a mainshaft and wherein each unit has a housing forming a cavity for each rotor which is supported for planetary rotation in the cavity on an eccentric portion of its associated mainshaft so as to form a plurality of working chambers defined between the rotor and housing and which working chambers expand and contract in volumetric size as the rotor planetates relative to the housing, the three-rotor modular mechanism comprising:

(a) the mainshaft for the two-rotor mechanism unit having its associated eccentric portions angularly offset from each other by 120 degrees;

(b) counterweights for each of the single rotor and two-rotor mechanism units being arranged relative to the associated mainshaft to dynamically balance each rotor mechanism unit;

(c) coupling means for connecting the mainshaft of each rotor mechanism unit so as to permit angular, radial and endwise flexibility and torsional stiffness for torque transmission between the connected mainshafts; and (d) said coupling means interconnecting the mainshafts so that the eccentric portion of the single unit is angularly offset 120 degress from the next adjacent eccentric portion of the mainshaft of the two-rotor mechanism unit to thus provide all eccentric portions of the three-rotor mechanism angularly displaced from each other 120 degrees.

2. The mechanism of claim 1 wherein intake port means is provided for introducing fluid into the working chambers and exhaust port means is provided to conduct fluid from the working chambers and wherein a first manifold is connected to pass fluid into each of the intake port means of each of said rotary mechanism units and a second manifold is connected to receive fluid from said exhaust port means of each of said rotary mechanism units.

3. The mechanism of claim 2 wherein said single rotor unit and two-rotor mechanism units are coaxially disposed with the profiles of all their housing cavities being axially aligned.

* * * * *